US005343214A

United States Patent [19]

Hadzoglou

[11] Patent Number: 5,343,214

[45] Date of Patent: Aug. 30, 1994

[54] CELLULAR MOBILE COMMUNICATIONS ANTENNA

[75] Inventor: James Hadzoglou, Mayfield Heights, Ohio

[73] Assignee: The Allen Telecom Group, Inc., Solon, Ohio

[21] Appl. No.: 919,618

[22] Filed: Jul. 24, 1992

Related U.S. Application Data

[63] Continuation of Ser. No. 711,347, Jun. 4, 1991, abandoned, which is a continuation of Ser. No. 593,492, Oct. 3, 1990, abandoned, which is a continuation of Ser. No. 22,888, Mar. 6, 1987, abandoned, which is a continuation-in-part of Ser. No. 799,202, Nov. 19, 1987, Pat. No. 4,839,660, which is a continuation of Ser. No. 535,273, Sep. 23, 1983, abandoned.

[51] Int. Cl.[5] ..... H01Q 1/32

[52] U.S. Cl. ..... 343/713; 343/715; 343/846; 343/850

[58] Field of Search ..... 343/713, 715, 704, 745, 343/829, 830, 846, 850, 861; H01Q 1/32, 9/30

[56] References Cited

U.S. PATENT DOCUMENTS

| | | | |
|---|---|---|---|
| 2,206,820 | 7/1940 | Mydlil | 343/712 |
| 2,541,107 | 2/1951 | Selgin | 343/830 |
| 3,268,897 | 9/1964 | Link | 343/713 |
| 4,089,817 | 5/1978 | Kirkendall | 343/713 |
| 4,184,160 | 1/1980 | Affronti | 343/712 |
| 4,238,799 | 12/1980 | Parfitt | 343/715 |
| 4,543,581 | 9/1985 | Nemet | 343/702 |
| 4,621,243 | 11/1986 | Harada | 343/713 |
| 4,658,259 | 4/1987 | Blaese | 343/713 |
| 4,779,098 | 10/1988 | Blaese | 343/713 |
| 4,794,319 | 12/1988 | Shimazaki | 343/715 |
| 4,839,660 | 6/1989 | Hadzoglou | 343/715 |

FOREIGN PATENT DOCUMENTS

| | | | |
|---|---|---|---|
| 3410950 | 9/1985 | Fed. Rep. of Germany | 343/715 |
| 8700974 | 2/1987 | World Int. Prop. O. | H01Q 9/30 |

OTHER PUBLICATIONS

Mobile Mark Spec. Sheet for Model OW-3900 on Window Antenna, Mobile Mark Inc., Franklin Pk-Il. Jul. 28, 1986.

*Primary Examiner*—Michael C. Wimer

*Attorney, Agent, or Firm*—Dressler, Goldsmith, Shore & Milnamow, Ltd.

[57] ABSTRACT

A mobile antenna system for use at frequencies in and above the 800 MHz band having a collinear radiator mounted on one surface of a dielectric such as the window of a vehicle. A coupling system is affixed to a second surface of the dielectric. The coupling system includes a counterpoise for coupling RF energy between the radiator and a transmission line connected to a suitable transceiver. Decoupling members connected to the counterpoise minimize coupling of radio frequency energy to defogger wires on the window.

80 Claims, 5 Drawing Sheets

FIG. 15
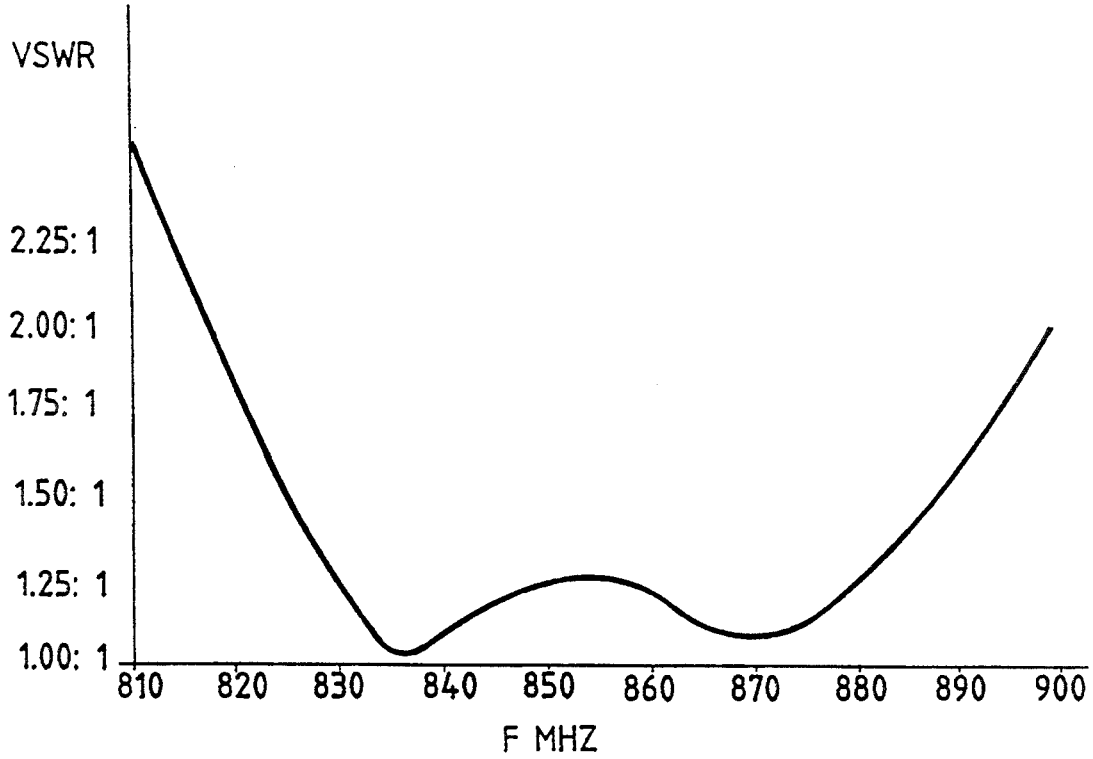
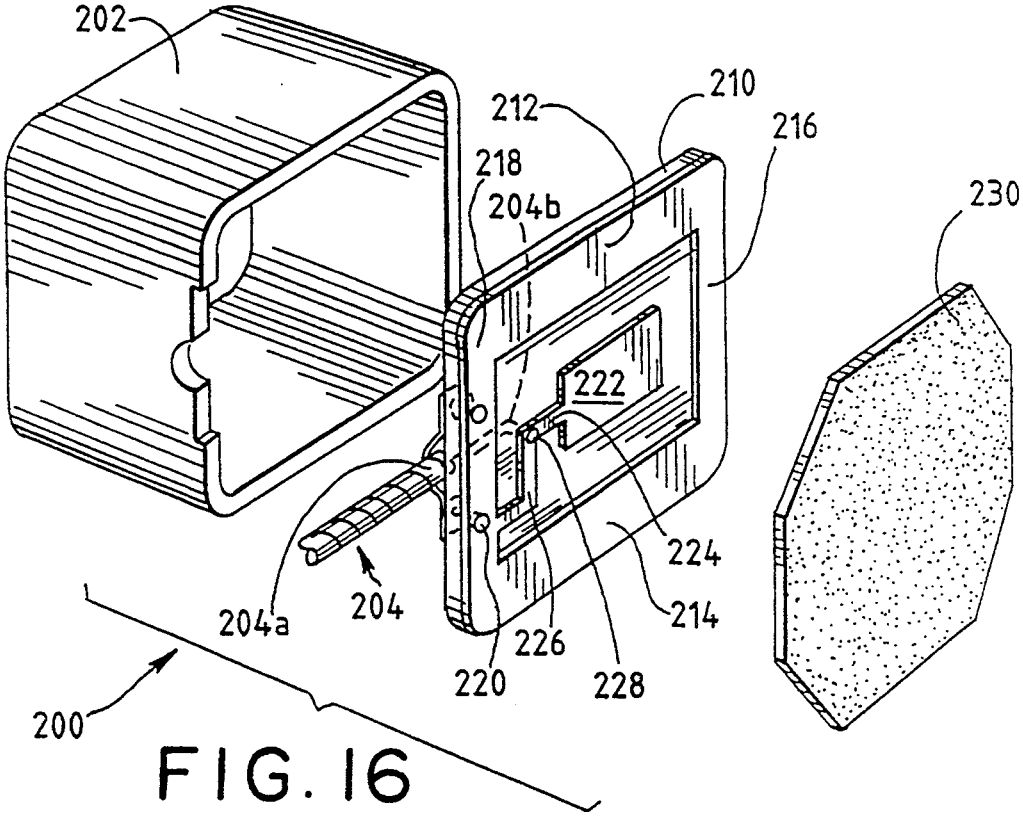
FIG. 16

CELLULAR MOBILE COMMUNICATIONS ANTENNA

This application is a continuation of application Ser. No. 07/711,347, filed Jun. 4, 1991, now abandoned; which was a continuation of application Ser. No. 07/593,492, filed Oct. 3, 1990, now abandoned; which was a continuation of application Ser. No. 07/022,888, filed Mar. 6, 1987, now abandoned; which was a continuation-in-part of application Ser. No. 06/799,202, filed Nov. 19, 1985, now U.S. Pat. No. 4,839,660; which was a continuation of application Ser. No. 06/535,273, filed Sep. 23, 1983, now abandoned.

FIELD OF THE INVENTION

The present invention relates to communications antennae. More particularly, the present invention pertains to broadband mobile communications transmission/reception antennae usable at frequencies in excess of 800 MHz and of the type adapted to be mounted on a non-conductive, dielectric surface such as a vehicle windshield.

BACKGROUND OF THE INVENTION

The recent introduction of cellular telephone services which utilize frequencies in the 800 MHz frequency band and above, has increased interest in efficient mobile antenna systems for those frequencies. Such services typically utilize a fairly broad bandwidth. For example, existing and/or proposed systems operate over frequency bands of about 800–870 MHz, 820–900 MHz, and 860–940 MHz. Different parts of each band are for transmission and reception. As can be seen by the above figures, the bandwidth of such operating systems ranges from between about 60 to about 80 MHz. Thus, any antenna designed for use with such systems should provide efficient radiation characteristics and low VSWR over these bandwidths In addition, the same antenna shjould be suitable for reception on frequencies adjacent to the transmission frequencies.

In addition, mobile antennae for such communications systems are designed to be mounted on vehicles. A form of permanent installation on the vehicle is often necessary. Preferred locations provide the uniform radiation patterns, such as vehicle rooftops. Roof mounting requires cutting holes in the body of the vehicle to permanently mount the antenna in place. This is not always a satisfactory arrangement for vehicle owners.

Alternate mounting locations, such as fenders or trunk lids, which may allow for different mounting techniques, result in deterioration in the desired uniformity in the radiation pattern. It would be desirable, therefore to have an antenna which could operate at these ultra-high frequencies with the required 60 MHz–80 MHz bandwidths and which at the same time could provide the desired operating characteristics without requiring vehicle marring mounting arrangements that require body repair when the antenna system is removed from the vehicle.

The mounting of a communications antenna on insulated surfaces such as the windshield or other window of an automotive vehicle is known for much lower frequencies. One such antenna system is disclosed in commonly assigned U.S. Pat. No. 4,238,799, which issued to Parfitt on Dec. 9, 1980. The disclosure of that patent is incorporated herein by reference.

The antenna system of the Parfitt patent is particularly adapted for operation in the CB and related bands at frequencies of about 28–29 MHz. These frequencies are well below the frequencies used for cellular phone communication systems. Further, the required bandwidth is not as great.

Antennae similar to and adapted from the antenna disclosed in the aforesaid U.S. Pat. No. 4,238,799 have been designed and operated at somewhat higher frequencies than those disclosed in that patent. However, as frequencies increase and reach the frequencies utilized in cellular phone systems, those at and above the 800 MHz band, structures utilized for lower frequencies are no longer appropriate.

Furthermore, the antenna disclosed in the Parfitt patent is a relatively narrow band antenna which does not operate satisfactorily over the wide frequency bands which are required for cellular phone systems.

Known cellular mobile on-glass antennae, such as those disclosed in the parent application hereto, Ser. No 799,202, entitled Cellular Mobile Communications Antenna, are often mounted on vehicle rear windows. It has been discovered that on occasion previously used, on-glass cellular mobile antennas physically overlapped the defogger wires on some vehicle rear windows. This overlap can result in undesirable coupling between the antenna and the defogger wires. The coupling results in degradation of the performance of the antenna, e.g. a reduction in radiated power.

There is thus a continuing need for cellular mobile antennae which are mountable on a vehicular dielectric member and which are decoupled from defogger wires located in or on the dielectric member.

In addition, the antenna of the above noted patent application is tunable. While a tunable antenna can provide excellent performance, the possibility of detuning by accident exists. Thus, there is a need for cellular mobile antennae that are not inadvertently detunable.

SUMMARY OF THE INVENTION

In accordance with the present invention, there is provided a relatively broadband communications antenna adapted to operate at and above the 800 MHz frequency range. The antenna is designed to be mounted on a dielectric surface such as the windshield of a vehicle. Antennae in accordance with the present invention provide excellent efficiency and gain as well as the desirable bandwidth on the order of at least 60–80 MHz to allow for efficient use at the cellular communications frequencies under consideration. The relatively broad bandwidth of the present antenna makes it possible to use the same antenna for both transmission and reception.

In accordance with the present invention, a vehicle window, e.g., the rear windshield, is utilized to efficiently couple RF energy to a multi-element collinear radiator mounted on the external surface of the windshield. In order to couple the RF energy between the antenna and a transceiver, a coupling system is mounted on a surface of the window in proximity to the antenna mount. The coupler presents an appropriate impedance to a transmission line. RF signals are received from the transmission line and capacitively coupled through the windshield to the exterior radiator.

The coupling system in accordance with the present invention, together with the radiator designed for use therewith, provides desired VSWR characteristics over the operating band ranges of 60 to 80 MHz such as contemplated for use in cellular telephone systems.

The window mounted antenna incorporating the present invention is capable of providing radiation characteristics comparable to antennae mounted on the roof tops of vehicles, provides desired omni-directional coverage and satisfactory gain without the distortion which may arise from mounting antennas on trunk lids and other less satisfactory locations on a vehicle. Further, antennae in accordance with the present invention can be used in combination with windows that incorporate electrical conductors. These conductors when energized heat and "defog" the window. They are present in rear windows of many new vehicles. The defogger conductors are typically affixed to the interior surface of the window.

More specifically, one embodiment of a communications antenna system incorporating the present invention utilizes a collinear radiator having a $\frac{5}{8}$ wave-length upper radiator and a lower radiator having an electrical length of between about $\frac{1}{4}$ and $\frac{1}{2}$ wave-length. The two radiators are separated by an air-wound phasing coil. One advantage of antennae in accordance with the present invention is the elimination of the ground plane required for a traditional quarter wave antenna.

The radiator is affixed at a base end to a mounting member. The mounting member can support the radiator adjacent a surface of the dielectric member.

At the frequencies at which antennae incorporating the present invention are used, one problem that arises is that the coaxial cable or transmission line connecting the antenna assembly to the transceiver can become "hot" or radiate radio frequency energy inside of the vehicle. In order to eliminate this problem, a counterpoise is provided.

The counterpoise can assume a variety of shapes. For example, it can be formed as a conductive housing. Alternatively, it can be formed as one or more planar members. The counterpoise is typically part of the coupling system which is supported adjacent a surface of the windshield or dielectric member.

The dielectric member essentially insulates the counterpoise from the body of the vehicle. A coaxial cable is used to couple the antenna to a vehicle mounted transceiver. The counterpoise is electrically coupled to the electrical ground of the vehicle only through the shield of the coaxial cable. Unlike grounded quarter wave antennae, antennae in accordance with the present invention are operable in the absence of a direct electrical connection between the counterpoise and the vehicle.

Disposed within the conductive housing are first and second inductive members. The inductive members interact such that in the 800–900 MHz range they provide an input impedance for the antenna with a magnitude on the order of 50 ohms. In one embodiment of the invention, these members are implemented as short pieces of conducting wire. For example, copper wire can be used. In another embodiment, foil or deposit conductors on a substrate can be provided with the necessary inductance.

The 50 ohm impedence point is electrically coupled to first or a center conductor of a coaxial cable connector affixed to the coupling system. A second or a shield conductor of the coaxial cable connector is electrically coupled to the counterpoise.

A free end of one of the inductive members is coupled to the counterpoise. A free end of a second inductive member is coupled to a capacitor plate. The capacitor plate is positionable adjacent a surface of the dielectric member between the electrical defogger conductors forming a part of the dielectric member. The radiator mounting member is positionable adjacent a second surface of the dielectric member, also between the defogger conductors and spaced apart from the capacitor plate by the thickness of that dielectric member.

Radio frequency energy from the transceiver is conducted through the second inductive member to the capacitor plate and then through the dielectric member to the radiator mounting member. The radio frequency energy is then radiated by the radiator.

To decouple the antenna from any interaction with the spaced apart defogger conductors in or on the dielectric member, first and second decoupling conductive members are located on each side of the capacitor plate. The first and second decoupling members overlap the two adjacent defogger conductors. The decoupling conductive members are electrically coupled to the counterpoise. The decoupling conductive members are oriented so as to be substantially parallel to and displaced from elongated edges of the capacitor plate.

The presence of the decoupling conductive members minimizes the transfer of radio frequency energy from the transceiver to the defogger conductors. Hence, more of the radio frequency energy from the transceiver is available to be radiated.

By utilizing a through-the-glass antenna assembly in accordance with the present invention, an antenna system results which is capable of producing omni-directional radiation at and above the 800 MHz band having a bandwidth defined by a VSWR less than 1.5 over a range of at least about 60–80 MHz. The antenna is suitable for use as a transmitting/receiving cellular phone system antenna providing desired gain and bandwidth capabilities. At the same time, as a result of use of the antenna system incorporating the present invention, neither the transmission line connecting the antenna to the transceiver nor the defogger conductors radiate radio frequency energy thereby minimizing two sources of energy loss.

In yet another embodiment of the invention, the elongated decoupling conductive members can be used as the counterpoise. In this embodiment, the metal housing is unnecessary. A simple plastic housing can be used. A coaxial connector could be used. Alternately, the end of the coaxial cable can be soldered or otherwise attached to the coupling system. An exterior conductor of the coaxial connector is electrically coupled to the spaced apart decoupling conductive members. An interior conductor of the coaxial connector is electrically coupled to the capacitor plate. The decoupling members and the capacitive coupling plate can be supported in spaced apart relationship by a non-conducting substrate. The substrate can be flexible or rigid.

Numerous other features and advantages of the present invention will become readily apparent from the following detailed description of the invention and the embodiments thereor, from the claims and from the accompanying drawings in which the details of the invention are fully and completely disclosed as a part of this specification.

BRIEF DESCRIPTION OF THE DRAWINGS

FIG. 15 is a VSWR plot of the antenna of FIG. 8; and

FIG. 16 is a perspective view of an alternate coupling system.

DETAILED DESCRIPTION OF A PREFERRED EMBODIMENT

Figure 1:
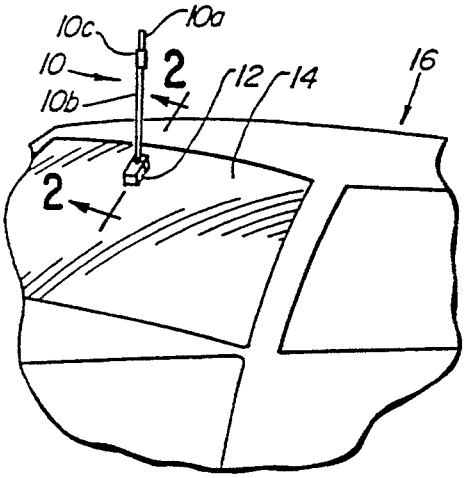
FIG. 1 is a perspective view showing installation of an antenna on a windshield.
Figure 2:
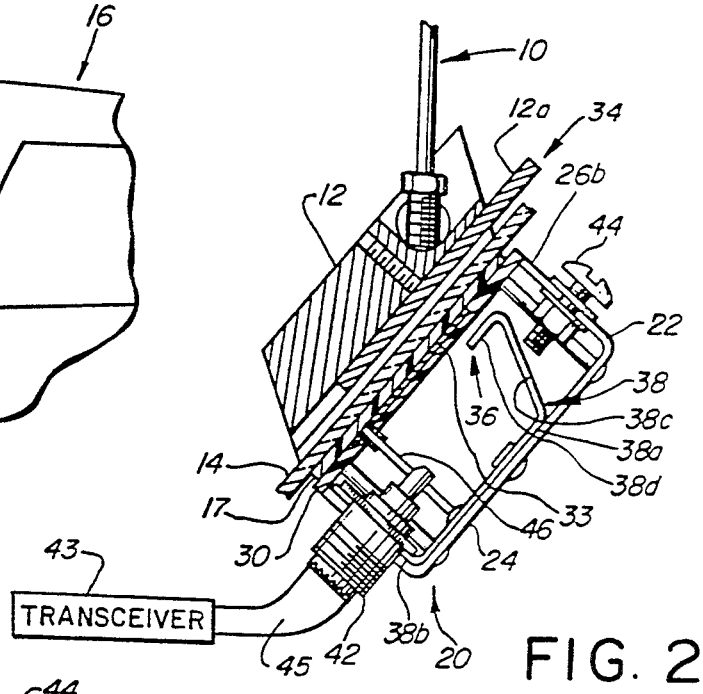
FIG. 2 is an enlarged cross-section taken along plane 2—2 of FIG. 1.
Figure 3:
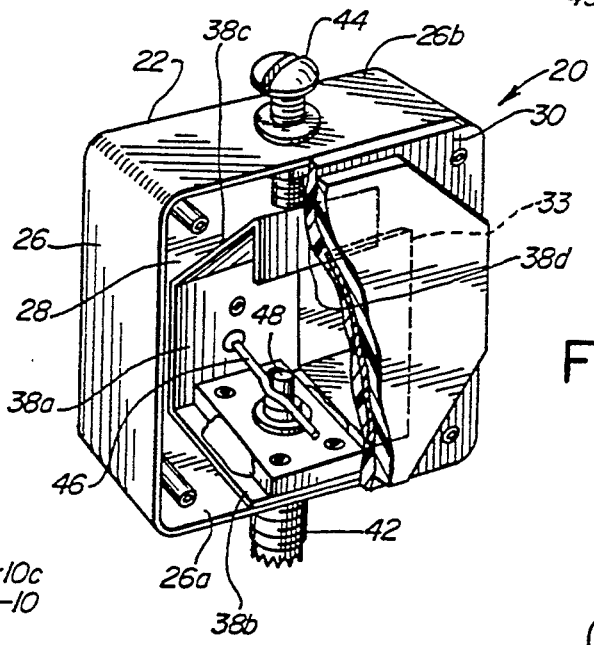
FIG. 3 is a perspective view, partially broken away of a feed or coupling assembly.
Figure 5:
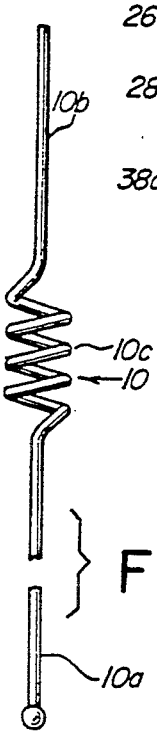
FIG. 5 is an elevational view showing a suitable antenna radiator.
Figure 4:
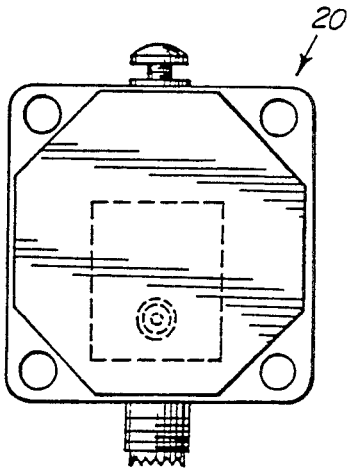
FIG. 4 is a side elevational view of the coupling housing.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Referring to the drawings, there is shown an on-glass antenna system. The antenna system includes an elongated collinear radiator 10 comprising an upper section 10*a* having an electrical length of approximately $\frac{5}{8}$ wave-length, and lower section 10*b* having an electrical length in excess of $\frac{1}{4}$ wave-length separated by an air wound phasing coil 10*c* having a length suitable for proper phasing at the frequency at which the antenna is to be used.

The radiator terminates in a base or foot 12 such as one shown in U.S. Pat. No. 4,238,799 or U.S. Pat. No. 4,266,227. The foot 12 has a generally flat surface adapted to be suitably affixed to the outer surface of a dielectric member such as a windshield 14 of a vehicle 16. A coupling or feed assembly 20 is affixed to the innser surface of the windshield 14 such as by adhesive 17 juxtaposed to the antenna base member 12.

The feed assembly 20 includes a conductive housing 22 having a front wall 24 and four side walls 26 with an open back 28. The conductive housing acts as a counterpoise for the antenna system as a result, the feed or transmission line between the antenna system and the transceiver does not radiate radio frequency energy and remains "cold". A metal member or plate 12*a*, attached to or forming part of the base 12, forms one plate of a coupling capacitor 34. The member 12*a* is positioned adjacent surface of the windshield 14. The capacitor 34 couples radio frequency energy to and from the radiator 10. The open back 28 is closed by a dielectric circuit board 30. The circuit board 30 includes a conductive foil plate 33 which defines the second plate of the coupling capacitor 34. The plate 33 is adjacent an opposite second surface or side of the windshield 14.

The inner coupling plate 33 also forms one plate of an adjustable tuning capacitor 36. The other plate of capacitor 36 is defined by a generally U-shaped bent member 38 having a generally planar base portion 38*a* lying along and affixed to the inner surface of front wall 24 of the conductive housing 22.

A standard transmission line coaxial connector 42 is disposed in one side wall 26*a* of the housing 22, and is connected to a transceiver 43 by means of a coaxial cable 45. The shield connection of the connector 42 is electrically connected to the housing 22 and to one leg 38*b* of the second tuning capacitor plate or U-shaped member 38 disposed generally perpendicular to the base 38*a* of the capacitor plate.

The other free leg 38*c* of the bent member 38 extends at a generally obtuse angle from the base 38 with the free end bent back to form a return 38*d* which overlaps and is spaced from the foil coupling plate 33. Adjustment of the capacitor 36 is achieved by utilizing a nonconductive member 44 which passes through the side wall 26*b* and engages the free end or leg 38*c* of the tuning capacitor plate 38 to displace the leg 38*c* inwardly and outwardly. This adjusts the amount of overlap between the capacitor plate return 38*d* and the coupling plate 33 to adjust the amount of capacitance thereof as is well known.

An inductor 46 in the form of a straight wire having a diameter to produce an inductance appropriate to the frequency to which the system is to be tuned is electrically connected to the base 38*a* of the adjustable capacitor plate 38 and to the foil 33 formed in the PC board dielectric. The center conductor 48 of the transmission line connector 42 is electrically connected to the inductor/wire 46 at a point between its ends to match the impedance of the transmission line itself of about 50 ohms.

Radio frequency energy is coupled from the center conductor 48 of the connector 42 through a part of the inductor/wire 46 to the plate 33 of the coupling capacitor 34. That energy is in turn coupled through the glass member 14 to the second plate 12*a* and then to the radiating member 10.

Figure 6:
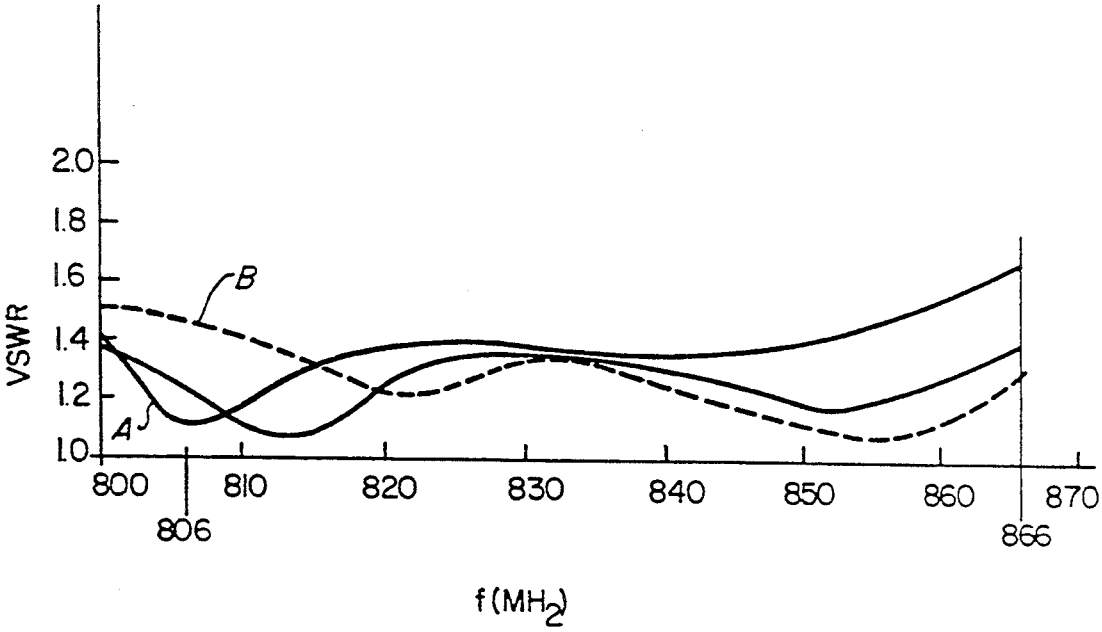
FIGS. 6 and 7 are VSWR plots for the antenna of FIG. 1.
Figure 7:
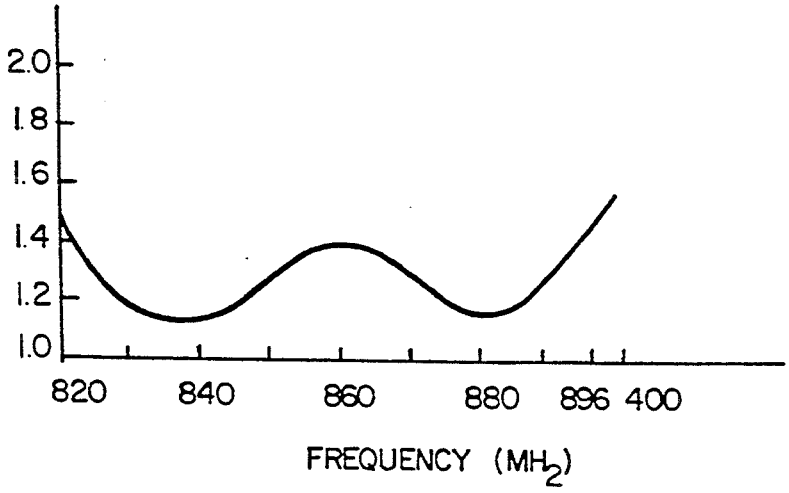

A system so constructed is capable of providing a significant bandwidth over the desired range of at least about 60 to 80 MHz. For example, in one embodiment of the antenna system incorporating the present invention an antenna was tuned at 806 MHz and maintained a VSWR below 1.5 between frequencies of about 800 MHz and about 860 MHz as shown at A in FIG. 6. An antenna tuned to 820 MHz maintained VSWR equal or less than 1.5 between a frequency of about 802 MHz to excess of 865 MHz as shown in B in FIG. 6. Another antenna that was designed for use in the 821–896 MHz band maintained a VSWR at or below 1.5 between the frequencies of 820 MHz and 895 MHz, as shown in FIG. 7.

Such an antenna system is able to provide a uniform radiation pattern as a function of radiation angle with a uniformity substantially similar to a roof mounted antenna and substantially better than trunk and cowl mounted antennas. Such uniformity is especially important for cellular phone type systems since communications using such systems occur in all directions and any reduction of gain in any particular direction would adversely affect the quality and ability of the mobile system to maintain communications.

Figure 8:
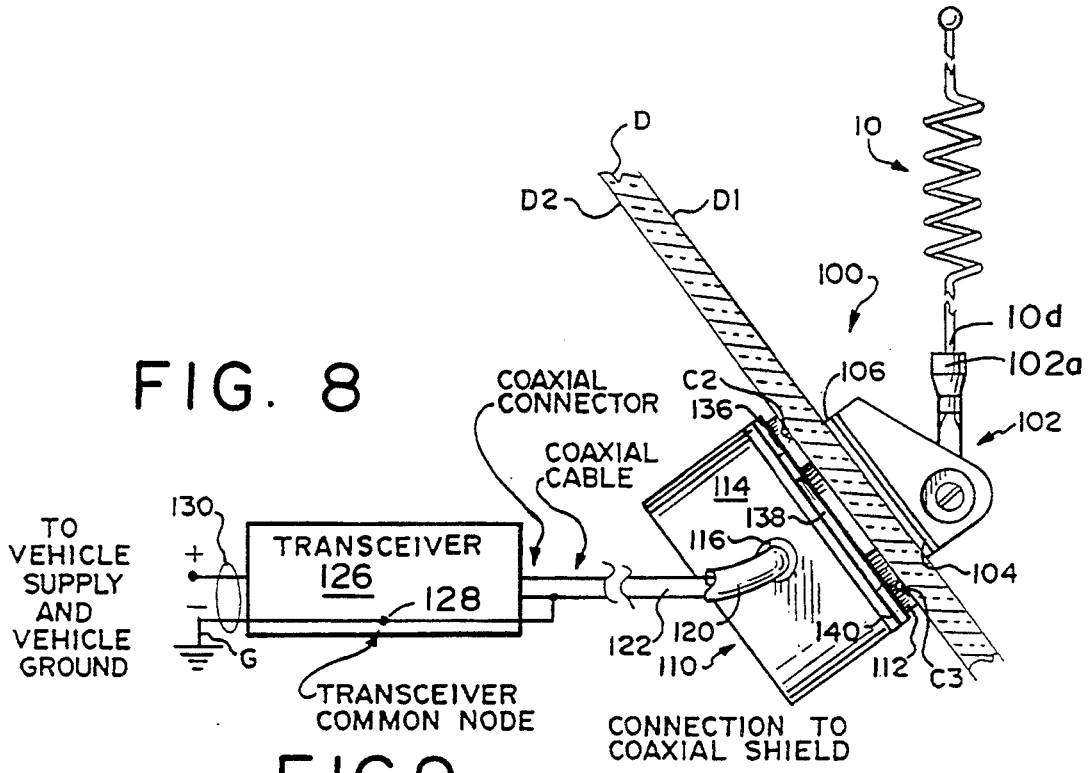
FIG. 8 is an overall schematic and diagramatic view of an antenna in accordance with the present invention mounted on a dielectric member containing defogger conductors.

FIG. 8 is an overall schematic and diagramatic view of an antenna 100 in accordance with the present invention. The antenna 100 includes the radiating member 10 which is affixed to and supported by a supporting member 102. The radiating member 10 threadably engages a mating socket 102*a* with threaded stud 10*d*. The socket 102*a* could be replaced with a threaded stud and the threaded stud 10*d* could be replaced with a mating socket in an alternate embodiment.

The supporting member 102 includes a planar, radio frequency coupling surface 104 which is positioned adjacent to and carried by a dielectric member D. An adhesive pad 106 affixes the supporting member 102 to a first surface D1 of the dielectric member D.

Figure 11:
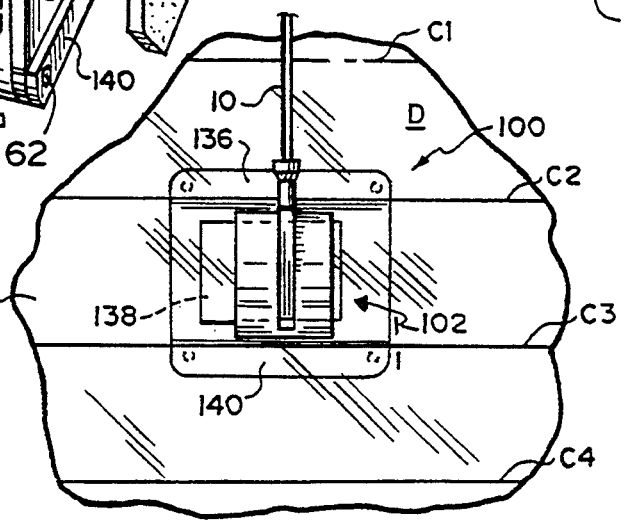
FIG. 11 is an elevational view of a portion of a dielectric member with defogger wires illustrating the spatial relationship between the defogger wires and the components of the antenna.

The dielectric member D could be a rear windshield of a vehicle. The dielectric member D includes spaced apart conductors or wires C1, C2, C3, C4 for the purpose of electrically heating and defogging the member. As can be seen in FIG. 11, the spaced apart conductive members or wires C1–C4 extend essentially parallel to one another in the dielectric member D.

The supporting member 102 is positioned between adjacent conductive members or defogger wires such as C2 and C3. The dimension 104*a* (see FIG. 13A) of the planar member 104 is such that it does not overlap either conductor C2 or conductor C3.

A coupling system 110 is positioned adjacent to a second surface D2 of the dielectric member D. The coupling system 110 can be affixed to the dielectric surface D2 by an adhesive layer or pad 112. The coupling system 110 includes a metal housing 114. The metal housing 114 defines a counterpoise for the antenna system 100. The housing 114, being affixed to and supported adjacent the surface D2 of the dielectric member D is insulated from the remainder of the vehicle by the dielectric member D. The antenna system 100 is capable of operation without a direct electrical connection between the counterpoise 114 and an adjacent electrical ground (such as a metal body) of the vehicle. The metal housing 114 carries a coaxial cable connector 116.

A coaxial cable 120 which engages the coaxial connector 116 has an exterior shield conductor 122 and an interior signal carrying conductor 124. The cable 120 couples the antenna system 100 to a vehicle mounted transceiver 126.

The transceiver 126 if desired could, also include a coaxial cable connector so that the cable 120 would be detachable both from the transceiver 126 and from the coupling system 110. It will be understood that cable 120 could be affixed to the coupling system without a coaxial connector such as 116. Such an alteration would not depart from the spirit and scope of the invention.

The external shield 122 of the coaxial cable 120 is coupled to the exterior or shield conductor 116*a* of the connector 116. The connector 116 as is conventional also includes a second insulated electrode or conductor 116*b*. The electrode 116*b* is in turn coupled to the center conductor 124 of the coaxial cable 120.

At the transceiver 126, the shield 122 of the coaxial cable 120 is connected electrically to a transceiver common node or ground 128. The transceiver 126 is in turn connected electrically to the vehicle electrical supply, such as a 12 volt battery, by cables 130.

The counterpoise 114 is thus electrically connected to an electrical ground G of the vehicle only through the shield 122 of the coaxial cable 120, via the transceiver. As noted above, the outside or shield conductor 116*a* of the coaxial connector 116 electrically couples the shield 122 to the counterpoise 114.

The effect of using the counterpoise 114, as discussed previously with respect to the counterpoise 22, is to suppress radio frequency radiation on the cable 120 during the time intervals when the transceiver 126 is transmitting to the radiator 10.

Figure 9:
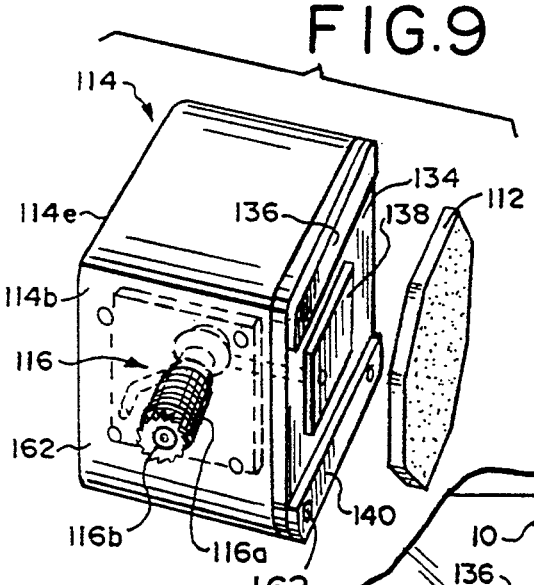
FIG. 9 is a perspective view of a coupling system of the antenna of FIG. 8.
Figure 10:
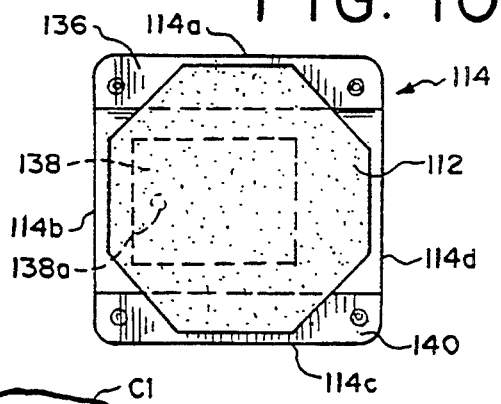
FIG. 10 is a side elevational view of the coupling system of FIG. 9.

FIGS. 9 and 10 illustrate further aspects of the structure of the counterpoise 114. In the embodiment of FIGS. 8–10, the counterpoise 114 is formed as a housing with a substantially square cross-section and four side walls 114*a–d* as well as a closed end 114*e*. The coaxial cable connector 116 is affixed to the wall 114*b*. As illustrated in FIG. 9, the exterior or first electrical contact 116*a* is electrically coupled to the metal housing wall 114*b*. The contact 116*a* is electrically coupled to the shield 122. The second or interior contact 116*b* is insulated from the exterior contact 116*a*. The contact 116*b* is electrically coupled to the conductor 124.

The housing 114 has an open end which is closed by a printed circuit board member 134. As best seen in FIG. 9, the printed circuit board member 134 is formed with three spaced apart planar foil elements 136, 138 and 140.

Conductive elements 136 and 140 are conductive decoupling elements which are electrically coupled to the housing 114 by a plurality of rivets 162. It will be understood that while rivets are disclosed in this preferred embodiment, any form of electrical and physical connection between the decoupling conductors 136 and 140 and the counterpoise 114 is within the spirit and scope of the present invention. The decoupling members 136, 140 are positioned so as to overlap the defogger conductors C2 and C3.

Positioned between the spaced apart metal decoupling members 136 and 140 is the planar foil or plate member 138 carried by the printed circuit board 134. The plate member 138 is coupled to the inner conductor 116*b* of the coaxial cable 116. The plate member 138 is positioned between the defogger conductors or wires C2 and C3 in or on the dielectric member D. The conductive decoupling members extend essentially parallel to spaced apart elongated edges of the capacitor plate 138.

The conducting plate member 138 forms one plate of a capacitor. The second plate of the capacitor is formed by the planar member 104. The two capacitor plate members 138 and 104 are positioned spaced apart from one another with the dielectric member D therebetween.

In the 800 Mhz range this capacitor formed of the plates 138 and 104 forms a means for coupling radio frequency energy in excess of 800 Mhz through the dielectric member D to the radiating member 10.

As can best be seen in FIG. 11, the decoupling conductive members 136 and 140 are positioned on the surface D2 so as to overlap the two adjacent defogger conductors or wires C2 and C3. This overlap results in the defogger wires C2 and C3 being decoupled from the antenna system 100. As a result, coupling of radio frequency energy to the defogger wires, such as C2 and C3 is minimized. Instead, this energy is transmitted through the dielectric member to the support member 102. The support member 102 is in turn electrically coupled to the radiator 10.

It will be understood that the counterpoise 114 could assume a variety of shapes. The exact shape of the counterpoise is not a limitation of the present invention. For example, instead of a closed housing it would be possible to use a shaped metal plate in electrical contact with the decoupling conductors 136 and 140 and the exterior contact 116*a* of the coaxial cable 116. In yet another embodiment of the invention, the connector 116 could be mounted in a plastic member with the exterior contact 116*a* in electrical contact with the decoupling conductive members 136 and 140 which also function as the counterpoise.

Figure 12:
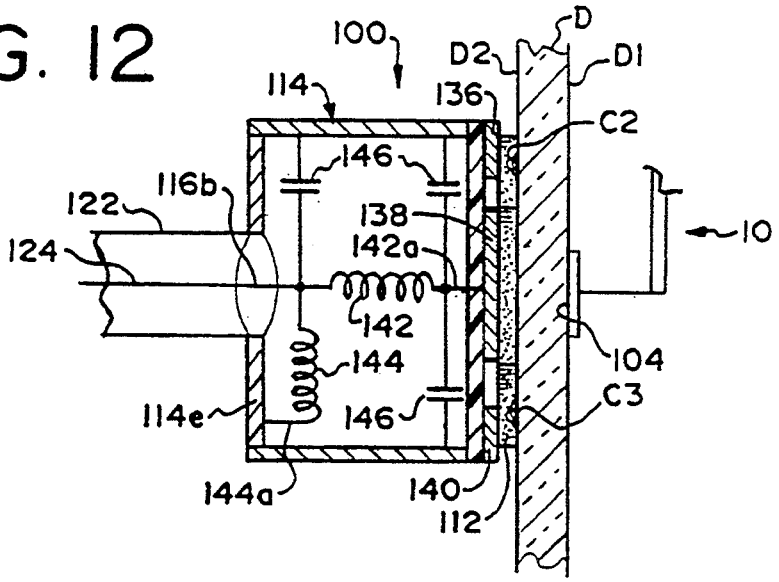
FIG. 12 is a partly schematic, partly diagrametric view of the present antenna.

FIG. 12 illustrates an equivalent circuit for the antenna 100. The shield conductor 122 of the coaxial cable 120 is electrically coupled to the housing 114 and to the decoupling conducting members 136 and 140. The center conductor 124 of the coaxial cable 120 is electrically coupled to first and second inductive members 142 and 144. Inductive member 142 is coupled at a free end 142*a* to the capacitor plate 138. Inductive member 144 is coupled at a free end 144*a* to the counterpoise 114. The inductive members 142 and 144 provide impedance matching between the 50 ohm coaxial cable 120 and the input impedance of the antenna system 100. In the 800–900 MHz range, the antenna system has an input impedance with a magnitude on the order of 400–500 ohms.

There is also distributed capacitance 146 present in the counterpoise 114. The exact value of this distributed capacitance is a function of the geometry and size of the counterpoise 114. In a preferred embodiment, the physical dimensions of the counterpoise 114 are on the order of 1.76 inches high by 1.76 inches wide by 0.96 inches deep. The interior capacitor plate 138 has an elongated dimension 138*b* on the order of 13/16 of an inch with a second dimension 138*c* on the order of $\frac{5}{8}$ of an inch. The conductive decoupling members 136 and 140 are each 1.76 inches long. The edges of the decoupling members adjacent the capacitor plate 138 are 1.0625 inches apart. The width of each of the members 136,140 is on the order of 0.348 inches. The printed circuit board 134 is formed of G10 epoxy with a 1 mil. thick copper foil.

It should be noted that the counterpoise 114 is insulatingly supported on the dielectric member D. The only electrical connection between the counterpoise 114 and the vehicle electrical ground G occurs through the shield 122 of the coaxial cable 120 and the common node 128 of the transceiver 126. Thus, antennae in accordance with the present invention are operable and do not require a ground connection between the counterpoise and an adjacent metal portion of the grounded body of the vehicle.

Figure 13A:
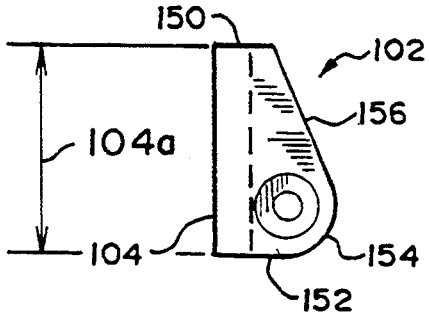
FIG. 13A is a side elevational view of a supporting member for the radiator of the present antenna.
Figure 13B:
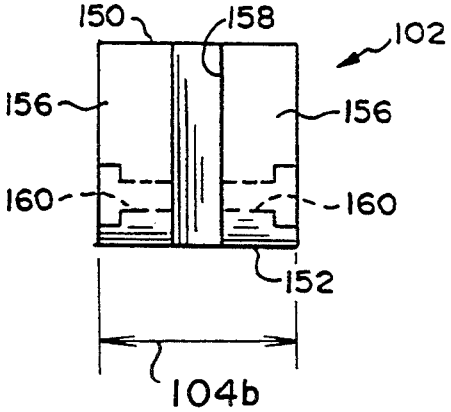
FIG. 13B is a front elevational view of the supporting member of FIG. 13A.

FIGS. 13A and B disclose further details of the physical structure of the supporting member 102. The planar surface 104 terminates in essentially perpendicular edges 150 and 152. The edge 152 terminates in a curved end 154 which is joined to the planar edge 150 by planar edge 156. The end 102*a* into which the radiator 10 is screwed is located in an exposed slot 158. Borings 160 are provided for threadably mounting two screws to affix the end 102*a* to the supporting member 102. Alternately, a single screw with a nut can be used.

The dimension 104*a* of the member 104 is on the order of $\frac{5}{8}$ of an inch. The dimension 104*b* is on the order of one inch.

Figure 14:
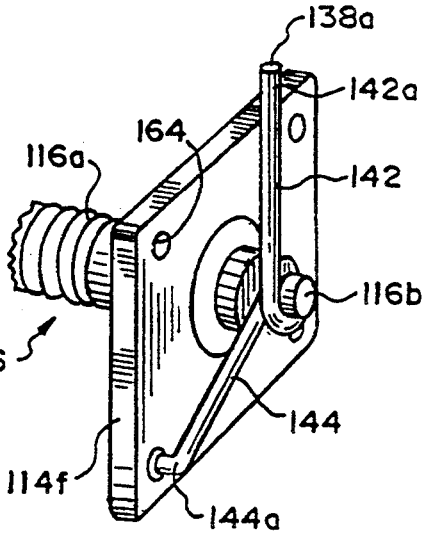
FIG. 14 is a perspective view of a plate supporting a coaxial connector as well as first and second inductive members.

FIG. 14 illustrates a plate 114*f* to which the coaxial cable connector 116 is affixed. The plate 114*f* in an electrical contact with the exterior conductor, or shield conductor, 116*a* of the connector 116. The plate 114*f* is mechanically attached to and electrically coupled to the counterpoise 114 by a plurality of rivets 162 which extend through holes 164 in the corners of the plate member 114*f*.

The inductive members 142 and 144 are illustrated in FIG. 14. At the 800 to 900 MHz range they can be implemented by essentially linear #16 wires formed of copper. In a preferred embodiment, a single #16 wire is formed with one section representing the inductive member 142 with a common end or node formed at the end of the contact 116*b* by simply wrapping a section of wire around the contact 116*b* to form the second inductive member 144. The free end 144*a* of the inductive member 144 can be soldered into one of the holes 164. The free end 142*a* of the inductive member 142 can be soldered to the capacitor plate 138 at a region 138A. The effective length of each of the members 142,144 is on the order of 5/16 of an inch.

FIG. 15 is a plot of the VSWR. characteristic of the antenna system 100 in the 800–900 MHz range. In addition to being a broadband antenna with a bandwidth on the order of 80 MHz, the antenna system 100 is not adjustable. Hence, it can not accidently be detuned. The antenna system 100 can be used for both reception and transmission. Hence, the antenna structure 100 is a bidirectional, receiving/transmitting, relatively broadband antenna. Further, as discussed earlier, the antenna system 100 does not lose power to the conductor or defogger wires C2 or C3 nor does it radiate on the coaxial cable 120.

An alternate embodiment of a coupling system 200 is illustrated in FIG. 16. The coupling system 200 is usable in the antenna system 100 as an alternate to the coupling system 110. The coupling system 200 includes a non-conducting, plastic, housing 202. A coaxial cable 204, corresponding to the cable 120, is provided to couple the coupling system 200 to the transceiver 126.

The coaxial cable 204 has an exterior conducting shield 204*a* and an interior center conductor 204*b*. The exterior conducting shield 204*a* is electrically coupled to the transceiver 126 and common node 128 in use.

The non-conductive housing 202 is closed by a non-conductive planar substrate 210. The substrate 210 could be formed, for example, of a G10 type epoxy printed circuit board. Formed on the non-conducting substrate 210 is a plurality of interconnected, conducting, planar foil members 212 through 218. The members 212 through 218 could be copper foil members of a type normally formed on printed circuit boards. The members 212 through 218 are all electrically coupled together and are in turn electrically coupled to the exterior conductor shield 204*a* of the coaxial cable 204 by rivets 220.

It will be understood that while rivets 220 are illustrated in FIG. 16, any type of mechanically stable electrical connection between the foil members 212 through 218 and the shield conductor 204*a* is within the spirit and scope of the present invention.

Also formed on the non-conducting substrate 210 is an elongated rectangular copper coupling member 222. The member 222 corresponds to the coupling member 138 of FIG. 9. The conductive coupling member 222 is electrically coupled to the center conductor 204*b* of the coaxial cable 204 by a foil inductive member 224. A second foil inductive member 226 is coupled between the center conductor 204*b* and the shield conductor 204*a*. The foil inductive members 224 and 226 intersect and are mechanically and electrically coupled to the conductor 204*b* at a region 228. The conductor 204*b* can be soldered to the inductive members 224 and 226 in the region 228.

The housing 202 and the non-conductive substrate 210 can be mechanically connected together in any conventional fashion such as by adhesives or snap fit. Adhesive layer 230 is positioned over the conductive members formed on the substrate 210.

The coupling system 200 can then be affixed to the surface D2 of the dielectric member D as was the coupling system 110. When so affixed, the elongated conducting foil members 212 and 214 overlap adjacent defogging conductors C2 and C3 positioned on or in the dielectric member D. The overlapping conductive foil members 212 and 214 form conductive decoupling members comparable to the decoupling members 136 and 140 discussed previously. In addition, the conductive members 212 through 218 define a counterpoise for the antenna system 100.

An antenna system 100 comprising the coupling system 200 has the same type of broadband characteristics as illustrated in FIG. 15. Further, the coupling system 200 cannot be inadvertently detuned as it has no adjustable members.

In addition to being usable with the supporting member 102 and radiator 10 illustrated in FIG. 8, the coupling system 200 is usable with alternate radiating members. Instead of the radiating member 10, the supporting member 102 can be used in combination with a straight or linear radiating member with a length between $\frac{1}{4}$ and $\frac{1}{2}$ wavelength. Alternately, the supporting member 102 can be used with a short base-loaded linear radiating member. In this instance, the antenna, including the base loading coil, has an overall length on the order of 8 inches.

Finally, it will be understood that a variety of non-conducting materials can be used for the supporting member or substrate 210. For example, instead of an epoxy material, milar or some other mechanically stable plastic could be used. In this instance, any technique that is conventional can be used to deposit the conducting members 212 through 228 on the milar substrate. Further, in such an embodiment, the plastic housing 202 could be dispensed with. In this instance, the milar substrate and electrical conductors deposited thereon in accordance with the FIG. 16 could be attached to the surface D2 of the dielectric member D by the adhesive layer 230. Further, in this instance the coaxial cable 204 could be affixed to the substrate 210 and conducting members thereon, as in FIG. 16, as shown with the rivets 220 or with any other form of mechanically stable connection. Alternately, the coaxial cable 204 could be replaced with flexible, printed, light weight transmission lines having 50 ohms characteristic impedance.

In an exemplary embodiment, the non-conducting substate 210 can be formed as a square member 1 and $\frac{3}{4}$ inches on a side. The width of the foil members 212 through 218 can be on the order of the width of the foil members 136 and 140. The coupling member 222 can be formed as a square member $\frac{5}{8}$ of an inch on a side. The copper foil members 212 through 226 can be formed of one mil thick copper.

Thus, there has been disclosed a mobile communications antenna system capable of use in the 800 HMz frequency band and above which does not require affixing to the metallic or conductive surface of a vehicle with the resulting damage thereto. This antenna provides desired uniformity of transmission as a function of horizontal angle which provides satisfactory gain in all direction and eliminates having a radiating cable disposed within the passenber compartment of such vehicles. The antenna also minimizes losses of radio frequency energy to the defogger conductors in the supporting dielectric member.

It will also be understood that antenna systems in accordance with the present invention are not limited to usage on vehicles. For example, cellular transceivers are from time to time mounted at stationary locations. In such an instance, the present antenna could readily be mounted on any convenient window or other dielectric member.

From the foregoing, it will be observed that numerous modifications and variations can be effected without departing from the true spirit and scope of the novel concept of the invention. It is to be understood that no limitation with respect to the specific apparatus illustrated herein is intended or should be inferred. It is, of course, intended to cover by the appended claims all such modifications as follow within the scope of the claims.

What is claimed is:

1. A communications antenna system usable to radiate radio frequency energy generated by a transceiver at frequencies in excess of 800 MHz and attachable to a dielectric member of a selected thickness, the dielectric member including at least spaced apart, adjacent first and second conducting members having a predetermined spacing therebetween, the antenna system comprising:

an elongated radiating member attached at one end to a supporting member, said supporting member having a planar metal coupling member with a first dimension less than the predetermined spacing between the adjacent conducting members with said coupling member positionable between the first and second conducting members, including means for affixing said supporting member to the dielectric member;

a coupling system affixable to the dielectric member, juxtaposed with said supporting member, said coupling system including, means for coupling radio frequency energy in excess of 800 MHz through the dielectric member to said radiating member, said means including first and second spaced-apart means for decoupling the antenna system from the first and second conducting members and a second planar metal coupling member carried between said decoupling means with said second coupling member positionable adjacent said planar metal coupling member between the first and second conducting members and spaced from those conducting members with said first decoupling means overlying the first conducting member spaced therefrom and with said second decoupling means overlying the second conducting member spaced therefrom and conductive means, coupled to said decoupling means, defining a counterpoise for the antenna system with said counterpoise including a shaped metal housing defining an interior volume with said coupling means contained at least in part therein.

2. An antenna system as in claim 1 wherein said decoupling means includes at least a first planar, elongated conductive decoupling member electrically coupled to said counterpoise.

3. An antenna system as in claim 1 wherein said decoupling means includes a pair of planar elongated, conductive decoupling members spaced apart from each other and electrically coupled to said counterpoise.

4. An antenna system as in claim 1 with said coupling means including means for supporting said decoupling means and said coupling means in spaced apart relationship.

5. An antenna system as in claim 1 with said counterpoise including at least one planar conducting member positionable adjacent a surface of the dielectric member.

6. An antenna system as in claim 5 with said planar conducting member supported on a non-conductive substrate.

7. An antenna system as in claim 6 wherein said non-conducting substrate is a rigid planar member.

8. An antenna system as in claim 6 wherein said non-conducting substrate is a flexible member.

9. An antenna system as in claim 8 wherein said flexible member is plastic.

10. An antenna system as in claim 2 with said supporting member affixable to a first surface of the dielectric member between adjacent dielectric conducting members with said coupling system affixable to a second surface of the dielectric member with said elongated conductive decoupling member positionable overlapping at least one of the dielectric conducting members.

11. An antenna as in claim 10 with said supporting member affixed so as to not overlap either of the adjacent dielectric conducting members.

12. An antenna system as in claim 2 including electrical connector means, having first and second conductive elements, with said first conductive element electrically coupled to said counterpoise and said decoupling member.

13. An antenna system as in claim 12 including a linear inductive member, having selected, fixed, inductive characteristics in the 800 MHz range coupled between said second conductive element and said coupling means.

14. An antenna system usable to radiate radio frequency energy generated by a transceiver at frequencies in excess of 800 MHz and attachable to a dielectric member of a selected thickness, the dielectric member including at least spaced apart, adjacent first and second conducting members having a predetermined spacing therebetween, the antenna system comprising:

an elongated radiating member attached at one end to a supporting member, said supporting member having a planar metal coupling member with a first dimension less than the predetermined spacing between the adjacent conducting members with said coupling member positionable between the first and second conducting members, including means for affixing said supporting member to the dielectric member;

a coupling system affixable to the dielectric member, juxtaposed with said supporting member, said coupling system including, means for coupling radio frequency energy in excess of 800 MHz through the dielectric member to said radiating member, said means including first and second spaced-apart means for decoupling the antenna system from the first and second conducting members and a second planar metal coupling member carried between said decoupling means with said second coupling member positionable adjacent said planar metal coupling member between the first and second conducting members and spaced from said planar metal coupling member by at least part of the thickness of the dielectric member, with said first decoupling means overlying the first conducting member spaced therefrom and with said second decoupling means overlying the second conducting member spaced therefrom;

electrical connector means, having first and second conductive elements, with said first conductive element electrically coupled to said decoupling means and including a first linear fixed length inductive member, having selected, fixed, inductive characteristics in the 800 MHz range and coupled between said second conductive element and said second planar coupling member.

15. An antenna system as in claim 14 including a counterpoise and a second linear inductive member, having selected, fixed, inductive characteristics in the 800 MHz range, electrically coupled between said second conductive element and said counterpoise.

16. An antenna system as in claim 15 with said first and said second linear inductive members forming in part a selected input impedance for the antenna in the 800 MHz range.

17. An antenna system as in claim 15 with said counterpoise including at least in part, a shaped metal housing defining an interior volume with said housing electrically coupled to said decoupling means.

18. An antenna system as in claim 15 with said counterpoise including, at least in part, a planar conducting member positionable adjacent a surface of the dielectric member.

19. An antenna system as in claim 18 usable on a vehicle with the dielectric member and transceiver mounted on the vehicle.

20. An antenna system as in claim 19 capable of operation in the absence of a direct electrical ground connection between said counterpoise and said vehicle, 21. An antenna system as in claim 15 with a bandwidth on the order of 60–80 MHz.

22. A communications antenna system usable to radiate radio frequency energy generated by a transceiver located in a vehicle at frequencies in excess of 800 MHz, and to receive radio frequency energy at frequencies in excess of 800 MHz, the antenna system attachable to a dielectric member of the vehicle, the dielectric member including spaced apart first and second, adjacent, elongated defogger conductors having a predetermined spacing therebetween, the antenna system comprising:

an elongated radiating member attached at one end to a supporting member, said supporting member having a planar metal coupling member with a first dimension less than the predetermined spacing and positionable between first and second of the defogger conductors, including means for attaching said supporting member to the dielectric member of the vehicle between the spaced apart defogger conductors; and a coupling system affixable to the dielectric member, juxtaposed with said supporting member, said coupling system including, conductive means including first and second shaped metal decoupling members, at least a portion of each being positionable adjacent the dielectric member overlapping a respective one of the adjacent defogger conductors so as to decouple the antenna system therefrom, said conductive means defining, at least in part, a counterpoise for said antenna system, means including a planar conducting coupling plate insulatingly supported and spaced from said first and second decoupling members and located therebetween for coupling radio frequency energy in excess of 800 MHz through the dielectric member, said means being located adjacent said planar metal coupling member and spaced therefrom by at least the thickness of the dielectric member when said decoupling members each overlap a respective defogger conductor, elongated transmission means having first and second transmission conductors with said first transmission conductor coupled to said decoupling members, and means for electrically coupling said coupling means to said second transmission conductor including a first linear inductive member having selected, fixed, inductive characteristics in the 800 MHz range and connected between said second conductor of said transmission means and said coupling means, said inductive member having a fixed physical length and connected between said decoupling members and said planar conducting coupling plate.

23. An antenna system as in claim 22 with said coupling means including a conducting coupling plate supported spaced from said counterpoise, and positionable adjacent a surface of the dielectric member between adjacent defogger conductors.

24. An antenna system as in claim 22 with said decoupling members supported by a non-conducting substrate in spaced apart relationship from said coupling means.

25. An antenna system as in claim 24 with said counterpoise including a shaped metal housing defining an interior volume with said coupling means contained at least in part therein.

26. An antenna system as in claim 22 including third and fourth planar conducting members coupled to said first and second decoupling members so as to form a parallelogram with said coupling means including said planar conducting coupling plate positioned within said parallelogram and spaced therefrom.

27. An antenna system as in claim 26 with said supporting member affixable to a first surface of the dielectric member between adjacent defogger conductors and with said coupling system affixable to a second surface of the dielectric member at least in part between adjacent defogger conductors.

28. An antenna system as in claim 27 including a non-conducting substrate supporting said conductive coupling plater and said parallelogram.

29. An antenna system as in claim 22 including a second linear inductive member, having selected, fixed, inductive characteristics in the 800 MHz range, electrically coupled between said second conductor of said transmission means and said decoupling members.

30. An antenna system as in claim 29 with said first and said second linear inductive members forming in part a selected input impedance for the antenna in the 800 MHz range.

31. An antenna system as in claim 30 with said selected antenna input impedance being on the order of 50 ohms.

32. An antenna system as in claim 23 with a usable bandwidth on the order of 60–80 MHz.

33. An antenna system as in claim 23 with a VSWR of less than 2.0 over a range of at least 820–890 MHz.

34. An antenna system as in claim 23 capable of operating without a direct electrical connection between said counterpoise and an adjacent metal portion of the vehicle which is also coupled to the vehicle electrical ground.

35. A relatively broadband mobile communications antenna system usable to radiate radio frequency energy at frequencies in excess of 800 MHz generated by a transceiver located in a vehicle and connected to the antenna system by an associated radio frequency transmission line, and to receive radio frequency energy at frequencies in excess of 800 MHz, the antenna system attachable to a dielectric member of the vehicle, the dielectric member including spaced apart, adjacent first and second defogger conducting members having a predetermined spacing therebetween, the antenna system comprising:

a radiator with attached supporting means, said supporting means affixable to a first surface of the dielectric member between the first and second spaced apart defogger members; and coupling means affixable to a second surface of the dielectric member including, a first conductive coupling portion positionable between the first and the second defogger members for coupling radio frequency energy, in excess of 800 MHz to said supporting means or for receiving radio frequency energy in excess of 800 MHz from said supporting means, first and second conductive decoupling portions oriented so as to extend generally parallel to one another, and each overlying a respective one of the first and second defogger members to decouple same from the antenna and to minimize the transfer of radio frequency energy therebetween with said coupling portion positioned between said decoupling portions, and means for matching the impedance between the antenna system and the associated radio frequency transmission line, said impedance matching means including first and second inductive members.

36. An antenna system as in claim 35 with said supporting means including planar conducting means positionable so as to over-lap essentially only said conductive coupling portion.

37. An antenna system as in claim 35 with said coupling means including means for matching the impedance between the antenna system and a radio frequency transmission line couplable thereto.

38. An antenna system as in claim 35 including conductive means defining a counterpoise, said counterpoise electrically coupled to said first and said second conductive decoupling portions, 39. An antenna system as in claim 38 with said counterpoise formed as a metal housing defining an interior region.

40. An antenna system as in claim 38 with said counterpoise including elongated spaced apart conducting members electrically coupled to said first and second decoupling portions.

41. An antenna system as in claim 35 with said first and said second decoupling portions defining at least in part a counterpoise for the antenna system.

42. An antenna system as in claim 40 operable in the absence of a direct electrical ground connection between said counterpoise and a grounded metal portion of the vehicle adjacent the dielectric member.

43. An antenna system as in claim 35 with said coupling means including an insulating substrate for supporting said coupling portion in a spaced apart relationship with said decoupling portions.

44. An antenna as in claim 43 wherein said substrate is rigid.

45. An antenna as in claim 43 wherein said substrate is flexible.

46. An antenna system as in claim 35 with said inductive members formed of essentially linear conductors.

47. An antenna system as in claim 35 with said first inductive member coupled between said conductive coupling portion and a conductor of the associated transmission line.

48. An antenna system as in claim 47 with said second inductive member coupled between said conductor of said line and said decoupling portions.

49. An antenna system as in claim 47 with a second conductor of said line coupled to said decoupling portions.

50. An antenna system as in claim 35 with said radiator formed of two essentially five-eights wavelength elongated sections coupled by a phasing coil.

51. An antenna system as in claim 35 with said radiator formed of an essentially linear elongated section with a length in a range between a quarter and a half wavelength.

52. An antenna system as in claim 35 including connector means carried by said coupling means.

53. A relatively broadband mobile communications antenna system usable to radiate radio frequency energy generated by a transceiver at frequencies in excess of 800 MHz and to receive radio frequency energy at frequencies in excess of 800 MHz, the antenna system attachable to a dielectric member, the dielectric member including at least first and second spaced apart, adjacent defogger conducting members, the antenna system comprising:

a radiator with attached supporting means, said supporting means affixable to a first surface of the dielectric member between the first and second spaced apart, adjacent defogger members; and coupling means affixable to a second surface of the dielectric member, said coupling means including a non-conducting substrate supporting a conductive coupling element positionable between the spaced apart, adjacent defogger members for coupling radio frequency energy, in excess of 800 MHz to said supporting means or for receiving radio frequency energy in excess of 800 MHz from said supporting means and further supporting, displaced and off-set from said coupling element, first, second, third and fourth conductive elements interconnected in a generally rectangular shape with said coupling element contained therein and with said first and said second elements overlying respective first and second adjacent defogger members to decouple same from the antenna and to minimize the transfer of radio frequency energy therebetween.

54. An antenna system as in claim 53 with said coupling means including means for matching the impedance between the antenna system and a radio frequency transmission line couplable thereto.

55. An antenna system as in claim 54 with said coupling means including means supported on a non-conductive substrate for matching the impedance between the antenna system and a radio frequency transmission line couplable thereto.

56. An antenna system as in claim 54 with said impedance matching means including first and second inductive members.

57. An antenna system as in claim 53 with said substrate being flexible.

58. An antenna system as in claim 53 with said substrate supporting counterpoise defining conductors electrically coupled to said first, second, third and fourth elements.

59. An antenna system as in claim 57 with said first, second, third and fourth elements formed as a parallelogram spaced from but enclosing said coupling element.

60. An antenna system as in claim 58 including impedance matching means supported by said substrate.

61. An antenna system as in claim 59 with said first, second, third and fourth elements, said coupling element and said impedance matching means formed as planar members on said substrate.

62. A relatively broadband mobile communications antenna system usable to radiate radio frequency energy generated by a transceiver located in a vehicle at frequencies in excess of 800 MHz and to receive radio frequency energy at frequencies in excess of 800 MHz, the antenna system is attachable to a dielectric member of the vehicle, the antenna system comprising:

a radiator with attached supporting means, said supporting means affixable to a first surface of the dielectric member; and coupling means affixable to a second surface of the dielectric member, said coupling means including a planar insulating member;

a generally rectangularly shaped conducting element carried by said insulating member;

a coupling plate carried by said insulating member, surrounded by said conducting element and spaced therefrom;

first and second inductive means carried by said insulating member with said first and second inductive means joined at a common node, with said first inductive means additionally coupled to said rectangularly shaped conducting element and with said second inductive means additionally coupled to said coupling plate;

a layer of adhesive carried by said insulating member; and cable means having first and second conducting portions with said first portion coupled to said common node and with said second portion coupled to said rectangularly shaped conducting element.

63. An antenna system as in claim 62 with said planar insulating member formed of a substantially rigid insulating material.

64. An antenna system as in claim 62 with said planar insulating member formed of a flexible insulating material.

65. An antenna system usable to radiate radio frequency energy generated by a transceiver at frequencies in excess of 800 MHz and adapted for use with and attachment to a dielectric member of a selected thickness, the dielectric member being of the type capable of including spaced apart, adjacent first and second conducting members having a predetermined spacing therebetween; comprising:

an elongated radiating member attached at one end to a supporting member, said supporting member having a first metal coupling member and including means for attaching said supporting member to the dielectric member, said first metal coupling member having a size permitting said first metal coupling member of being positioned between any such spaced apart, adjacent first and second conducting members included as a part of the dielectric member;

electrical connector means having first and second conductive elements;

a coupling system attachable to the dielectric member, juxtaposed with said first coupling member, for coupling radio frequency energy in excess of 800 MHz through the dielectric member to said first coupling member and thereby to said radiating member, including second and third planar elongated conductive members spaced apart form each other;

a fourth planar metal coupling member carried between and spaced from both of said second and third planar elongated conductive members, said fourth planar coupling member being positionable opposite said first metal coupling member and spaced therefrom by the thickness of the dielectric member;

an inductive member having selected, fixed, inductive characteristics in the 800 MHz range and coupled between said second conductive element of said connector means and said fourth planar coupling member; and first and second spaced-apart means for decoupling the antenna system from any such spaced apart, adjacent first and second conducting members included as a part of the dielectric member;

said first conductive element of said connector means being electrically coupled to said second and third planar elongated conductive members.

66. An antenna system as in claim 65 wherein:

said first and second spaced-apart decoupling means include said second and third planar elongated conductive members.

67. A relatively broadband mobile communications antenna system usable to radiate radio frequency energy at frequencies in excess of 800 MHz generated by a transceiver located in a vehicle and connected to the antenna system by an associated radio frequency transmission line, and to receive radio frequency energy at frequencies in excess of 800 Mhz, the antenna system attachable to a dielectric member of the vehicle, the dielectric member being of the type capable of including spaced apart, adjacent first and second defogger conducting members having a predetermined spacing therebetween, the antenna system comprising:

a radiator with attached supporting means, said supporting means affixable to a first surface of the dielectric member and being of a dimension capable of location between any such spaced apart adjacent first and second defogger conducting members included as part of said dielectric member; and coupling means affixable to a second surface of the dielectric member including, a first conductive coupling portion being of a dimension capable of location between any such spaced apart adjacent first and second defogger conducting member for coupling radio frequency energy, in excess of 800 Mhz to said supporting means or for receiving frequency energy in excess of 800 Mhz from said supporting means, second and third planar conductive decoupling portions oriented so as to extend generally parallel to one another, and each designed to be capable of overlying a respective one of any such adjacent first and second defogger conducting members included as part of said dielectric member to decouple same from the antenna and to minimize the transfer of radio frequency energy therebetween, said coupling portion being spaced from, positioned between, and lying substantially in the same plane as, said second and third planar conductive decoupling portions, and means for matching the impedance between the antenna system and the associated radio frequency transmission line, said impedance matching means including first and second inductive means.

68. An antenna system as in claim 67 wherein:

the maximum distance between the periphery of said first conductive coupling portion and the farthest point of said first and second planar conductive decoupling portions is less than $\frac{1}{4}$ wave length at frequencies in excess of 800 Mhz.

69. An antenna system as in claim 67 wherein:

the maximum distance between the two farthest points of said first and second planar conductive decoupling portions is less than $\frac{1}{2}$ wave length at frequencies in excess of 800 Mhz.

70. A relatively broadband mobile communications antenna system usable to radiate radio frequency energy generated by a transceiver at frequencies in excess of 800 MHz and to receive radio frequency energy at frequencies in excess of 800 MHz, the antenna system attachable to a dielectric member, the antenna system comprising:

a radiator with attached supporting means, said supporting means affixable to a first surface of the dielectric member; and coupling means affixable to a second surface of the dielectric member, said coupling means including a non-conducting substrate supporting a conductive coupling element adjacent to said second surface of said dielectric member for coupling radio frequency energy, in excess of 800 MHz to said supporting means and said radiator attached thereto, and for receiving radio frequency energy in excess of 800 MHz from said supporting means and said radiator attached thereto, and further supporting first, second, third and fourth conductive element interconnected in a generally closed path with said coupling element lying substantially in the same plane as, contained in and displaced and off-set from said interconnected first, second, third and fourth conductive elements.

71. An antenna system as in claim 70 wherein:

the maximum distance between the periphery of said conductive coupling element and the farthest point of any of said first, second, third and fourth interconnected conductive elements is less than $\frac{1}{4}$ wave length at frequencies in excess of 800 Mhz.

72. An antenna system as in claim 70 wherein:

the maximum distance between the two farthest points of said first, second, third and fourth interconnected conductive elements is less than $\frac{1}{2}$ wave length at frequencies in excess of 800 Mhz.

73. A relatively broadband mobile communications antenna system usable to radiate radio frequency energy generated by a transceiver located in a vehicle at frequencies in excess of 800 MHz and to receive radio frequency energy at frequencies in excess of 800 MHz, the antenna system being attachable to a dielectric member of the vehicle, the antenna system comprising:

a radiator with attached supporting means, said supporting means affixable to a first surface of the dielectric member; and coupling means affixable to a second surface of the dielectric member, said coupling means including a planar insulating member;

a coupling plate carried by said insulating member, a generally planar continuous conducting element carried by said insulating member and disposed around and in substantially the same plane as said coupling plate and spaced therefrom;

inductive means carried by said insulating member with said inductive means being coupled to said generally planar continuous conducting element and to said coupling plate;

a layer of adhesive carried by said insulating member; and cable means having first and second conducting portions with said first conducting portion of said cable means coupled to said inductive means and with said second conducting portion of said cable means coupled to said generally planar continuous conducting element.

74. An antenna system as in claim 73 wherein said generally continuous conducting element carried by said insulating member is generally closed, and said coupling plate is surrounded by said generally planar closed continuous conducting element.

75. An antenna system as in claim 74 including:

conductive means at least in part including a shaped metal housing, coupled to said generally planar closed continuous conducting element and defining at least in part a counterpoise for the antenna system.

76. An antenna system as in claim 74 including;

a conductive counterpoise including at least in part said generally planar closed continuous conducting element.

77. An antenna system as in claim 76 wherein:

said antenna system is capable of operation to radiate radio frequency energy generated by a transceiver connected thereto at frequencies in excess of 800 MHz in the absence of a direct radio frequency electrical ground connection between said counterpoise and said vehicle.

78. An antenna system as in claim 77 with a bandwidth on the order of 60–80 Mhz.

79. An antenna system as in claim 73 wherein:

the maximum distance between the periphery of said coupling plate and the farthest point of said generally planar continuous conducting element is less than $\frac{1}{4}$ wave length at frequencies in excess of 800 Mhz.

80. An antenna system as in claim 73 wherein:

the maximum distance between the two farthest points of said generally planar continuous conducting element is less than $\frac{1}{2}$ wave length at frequencies in excess of 800 Mhz.

* * * * *